US006943487B1

(12) United States Patent
Ryu

(10) Patent No.: US 6,943,487 B1
(45) Date of Patent: Sep. 13, 2005

(54) VACUUM FLUORESCENT DISPLAY HAVING COMPLEX-TYPE FILAMENT SUPPORTS

(75) Inventor: Dong-Jin Ryu, Busan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 132 days.

(21) Appl. No.: 10/630,758

(22) Filed: Jul. 31, 2003

(30) Foreign Application Priority Data

Aug. 22, 2002 (KR) ..... 10-2002-0049759

(51) Int. Cl.[7] ..... H01J 19/42; H01J 1/88
(52) U.S. Cl. ..... 313/278; 313/272; 313/495
(58) Field of Search ..... 313/495–497, 313/271–272, 278, 257, 269, 292, 50–51, 313/513–514, 456, 422; 445/24–25, 29, 33

(56) References Cited

U.S. PATENT DOCUMENTS 5,179,317 A * 1/1993 Watanabe et al. ..... 313/496
5,424,607 A * 6/1995 Jeong ..... 313/496
5,811,920 A * 9/1998 Wada et al. ..... 313/422
6,717,350 B2 * 4/2004 Yonezawa et al. ..... 313/495
2004/0051442 A1 * 3/2004 Kanesaka ..... 313/493

FOREIGN PATENT DOCUMENTS

JP 04324236 A * 11/1992 ..... H01J 31/15

* cited by examiner

*Primary Examiner*—Karabi Guharay
(74) *Attorney, Agent, or Firm*—Robert E. Bushnell, Esq.

(57) ABSTRACT

A vacuum fluorescent display including first and second substrates provided opposing one another, and a side glass provided between the first and second substrates to seal a space therebetween; filaments for emitting electrons when a voltage is applied thereto; first and second complex-type filament supports mounted to one of the substrates and supporting opposite sides of each of the filaments; and an anode provided on at least one of the substrates, the anode being illuminated by electrons to realize images, wherein each of the first and second complex-type filament supports includes a fixed plate fixedly mounted to the substrate, at least one tension arm mounted to the fixed plate, at least one tension head provided on a distal end of each of the tension arms, and at least one tensionless head to which one of the filaments is attached, the tensionless head being mounted to one of the tension arms.

14 Claims, 7 Drawing Sheets

VACUUM FLUORESCENT DISPLAY HAVING COMPLEX-TYPE FILAMENT SUPPORTS

CLAIM OF PRIORITY

This application makes reference to, incorporates the same herein, and claims all benefits accruing under 35 U.S.C. §119 from an application for VACUUM FLUORESCENT DISPLAY HAVING COMPLEX-TYPE FILAMENTSUPPORTS earlier filed in the Korean Intellectual Property Office on 22 Aug. 2002 and there duly assigned Serial No. 2002-49759.

BACKGROUND OF THE INVENTION

1. Field of the Invention

The present invention relates to a vacuum fluorescent display, and more particularly, to a vacuum fluorescent display having complex-type filament supports, which include both a tension head and a tensionless head.

2. Description of the Related Art

A vacuum fluorescent display (VFD) is a type of electron tube that is able to recognize input/output states and operational conditions of various machines and apparatuses. VFDs are being used more and more frequently as a result of developments in various industrial machines.

The conventional VFD includes a vacuum container having an inner space that is maintained in a Vacuum state and provides a view area in one direction that is transparent, an anode provided within the vacuum container and receiving electrons to illuminate and display predetermined signals, filaments fixedly welded to a pair of filament supports to receive an external power and emit electrons, and a grid electrode for accelerating and diffusing (or for blocking) the electrons emitted from the filaments.

The vacuum container includes a lower substrate on which the anode is provided, an upper substrate (not shown) provided opposing the lower substrate at a predetermined distance form the same and formed to allow for easy passage of light therethrough, and a side glass formed between the lower substrate and the upper substrate at outside edges of the same to thereby seal the space between the lower substrate and the upper substrate. This space in the vacuum container is maintained in a high vacuum state to allow for easy emission and movement of electrons.

The filament supports fix both ends of the filaments such that the filaments are suspended at a predetermined distance from the anode. The filaments are supported by the filament supports such that a predetermined tension is provided in the filaments, even with the expansion of the filaments when they become heated.

Each of the filament supports includes a fixing plate welded to a mount of a lead frame, which is connected to the first substrate; tension heads, each corresponding to one of the filaments to fixedly secure the same; and tension arms interconnecting the tension heads and the fixing plate. The tension arms have a length L1 of approximately 2.5 mm in order to provide tension to the tension heads. A length of the tension arms in a state where the filaments are attached to the tension heads is L2. In the following, it will be assumed that the length L2 of the tension arms when the filaments are connected to the tension heads is the same as the length of the tension arms when the same are in a relaxed state.

The VFD including the conventional filament supports as described above has the following drawbacks.

If the frit glass for sealing the side glass and the lower substrate contacts the tension arms, the tension arms lose their tension such that they are unable to support the filaments. Further, if the frit glass is deposited on part of the fixing plates, when the frit glass is heated to seal the lower substrate and the side glass, cracks may develop in the frit glass as a result of the difference in thermal expansion coefficients between the frit glass and the filament supports. As a result, foreign substances (frit particles) are created so that the inside of the VFD becomes contaminated. Also, this causes the fixing plates to become loose or disconnected from the mounts to thereby cause shaking of the filaments.

To overcome these problems, a gap of 0.85 mm or more is maintained between the fixing plates and the side glass such that contact between the frit glass and the filament supports is prevented.

Therefore, in the VFD having the conventional filament supports, a significant amount of space is unable to be used by the anode electrodes as viewing space. That is, the 0.85 mm for the gap between short sides of the fixing plates and the side glass, and the length L2 of 2.5 mm for the tension arms when the filaments are attached to the tension heads combine for a total of approximately 3.3 mm that can not be used by the anode electrodes as viewing space. This increases the overall size of the VFD.

SUMMARY OF THE INVENTION

It is one object of the present invention to provide a vacuum fluorescent display having a complex-type filament support, which includes both a tension head and a tensionless head.

It is another object of the present invention to provide a vacuum fluorescent display having a complex-type filament support, which includes both a tension head and a tensionless head that is simple and cost effective to manufacture.

It is yet another object of the present invention to provide a vacuum fluorescent display having a complex-type filament support, which includes both a tension head and a tensionless head that does not necessarily increase the overall size of the VFD and provides firm proper support for the filaments.

In one embodiment, the present invention provides a vacuum fluorescent display including first and second complex-type filament supports, each complex-type filament support including a fixed plate fixedly mounted to the substrate, at least one tension arm mounted to the fixed plate, at least one tension head provided on a distal end of each of the tension arms, and at least one tensionless head to which one of the filaments is attached, the tensionless head being mounted to one of the tension arms.

The first and second complex-type filament supports are provided such that a tensionless head or a tension head is mounted to the second complex-type filament support opposing a tension head of the first complex-type filament support, and a tension head is mounted to the second complex-type filament support opposing a tensionless head of the first complex-type filament support.

The first and second complex-type filament supports satisfy Equation 1:

$$M=M'=N-(N-1) \quad \text{[Equation 1]}$$

where M is a total number of the tensionless heads provided on the first complex-type filament support, M' is a total number of the tensionless heads provided on the second complex-type filament support, and N is a total number of the filaments.

The tensionless heads are provided toward short ends along a lengthwise direction of the fixed plates. Preferably, the tensionless heads are integrally formed to the tension arms at ends of the same opposite where the tension heads are formed.

Also, a cutaway section is formed in each of the tensionless heads such that a gap between the tension heads and the tensionless heads is increased.

In another aspect, the first and second complex-type filament supports satisfy Equation 2:

$$M=N-(N-1)$$

$$N-(N-2)\leqq M'N-1 \qquad \text{[Equation 2]}$$

where M is a total number of the tensionless heads provided on the first complex-type filament support, M' is a total number of the tensionless heads provided on the second complex-type filament support, and N is a total number of the filaments.

In the second preferred embodiment, the tensionless heads formed on the first complex-type filament support are provided identically as in the first preferred embodiment. However, among all of the tensionless heads formed on the second complex-type filament support, the tensionless heads provided toward short ends along the lengthwise direction of the fixed plates are integrally formed to the tension arms at ends of the same opposite where the tension heads are formed.

In yet another aspect, the first and second complex-type filament supports satisfy Equation 3:

$$N-(N-2)\leqq M\leqq(N-1)$$

$$N-(N-2)\leqq M'(N-1) \qquad \text{[Equation 3]}$$

where M is a total number of the tensionless heads provided on the first complex-type filament support, M' is a total number of the tensionless heads provided on the second complex-type filament support, and N is a total number of the filaments.

In this embodiment, among all of the tensionless heads, the tensionless heads provided toward short ends along the lengthwise direction of the fixed plates are integrally formed to the tension arms at ends of the same opposite where the tension heads are formed.

With this configuration, the length of the filament supports can be decreased by approximately 2.5 mm over the prior art filament supports by integrally forming at least one tensionless head to one of the tension arms. As a result, the overall size of the vacuum fluorescent display may be reduced or the display area of the same may be increased for the same size device over the prior art.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
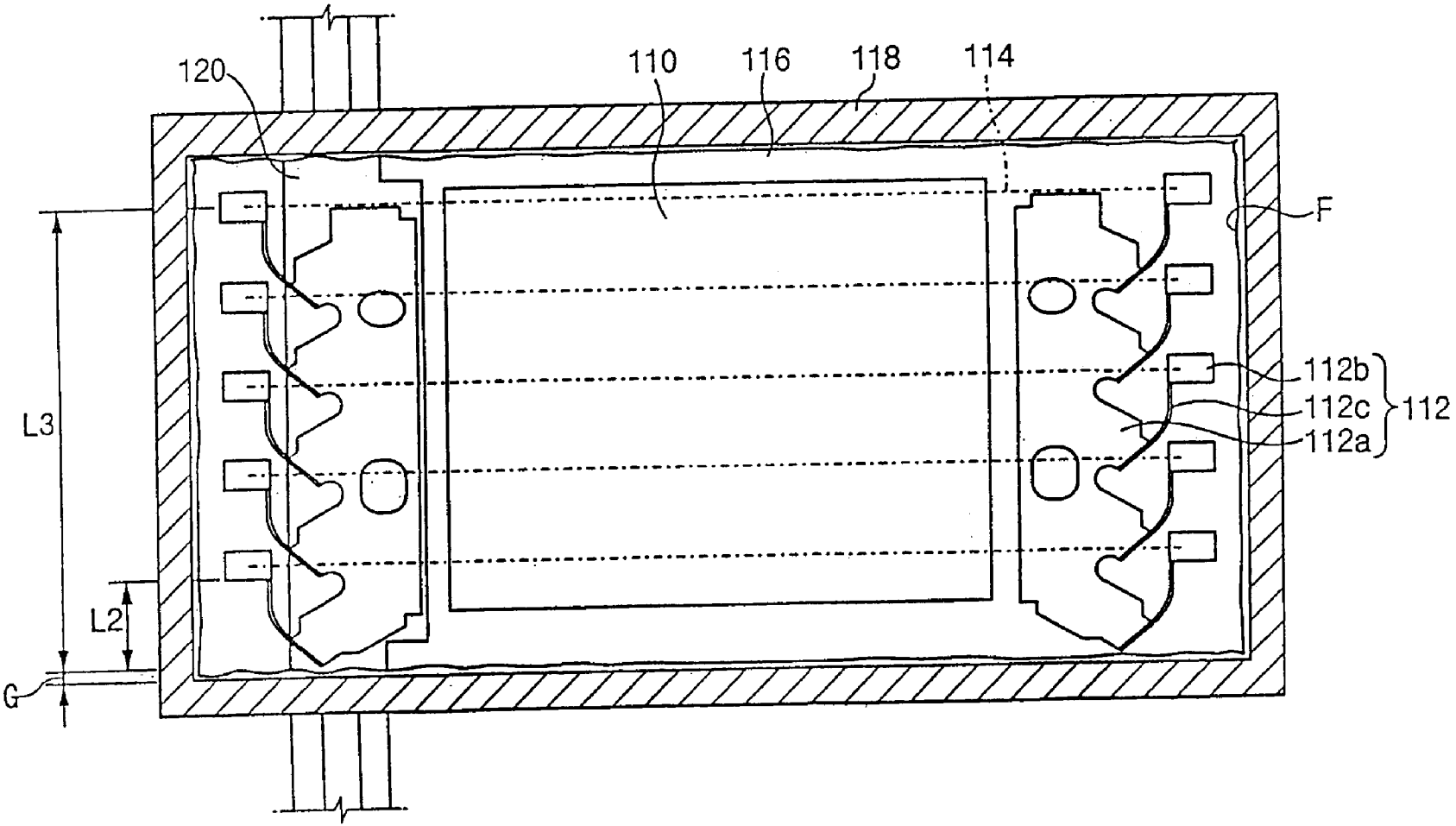
Fig. 1 (PRIOR ART)
FIG. 1 is a plan view of a conventional vacuum fluorescent display in a state where filaments are mounted to filament supports.

Turning now to the drawings, as shown in FIG. 1, the conventional VFD includes a vacuum container having an inner space that is maintained in a vacuum state and provides a view area in one direction that is transparent, an anode 110 provided within the vacuum container and receiving electrons to illuminate and display predetermined signals, filaments 114 fixedly welded to a pair of filament supports 112 to receive an external power and emit electrons, and a grid electrode (not shown) for accelerating and diffusing (or for blocking) the electrons emitted from the filaments 114.

The vacuum container includes a lower substrate 116 on which the anode 110 is provided, an upper substrate (not shown) provided opposing the lower substrate 116 at a predetermined distance form the same and formed to allow for easy passage of light therethrough, and a side glass 118 formed between the lower substrate 116 and the upper substrate at outside edges of the same to thereby seal the space between the lower substrate 116 and the upper substrate. This space in the vacuum container is maintained in a high vacuum state to allow for easy emission and movement of electrons.

The filament supports 112 fix both ends of the filaments 114 such that the filaments 114 are suspended at a predetermined distance from the anode 110. The filaments 114 are supported by the filament supports 112 such that a predetermined tension in provided in the filaments 114, even with the expansion of the filaments 114 when they become heated.

Figure 2:
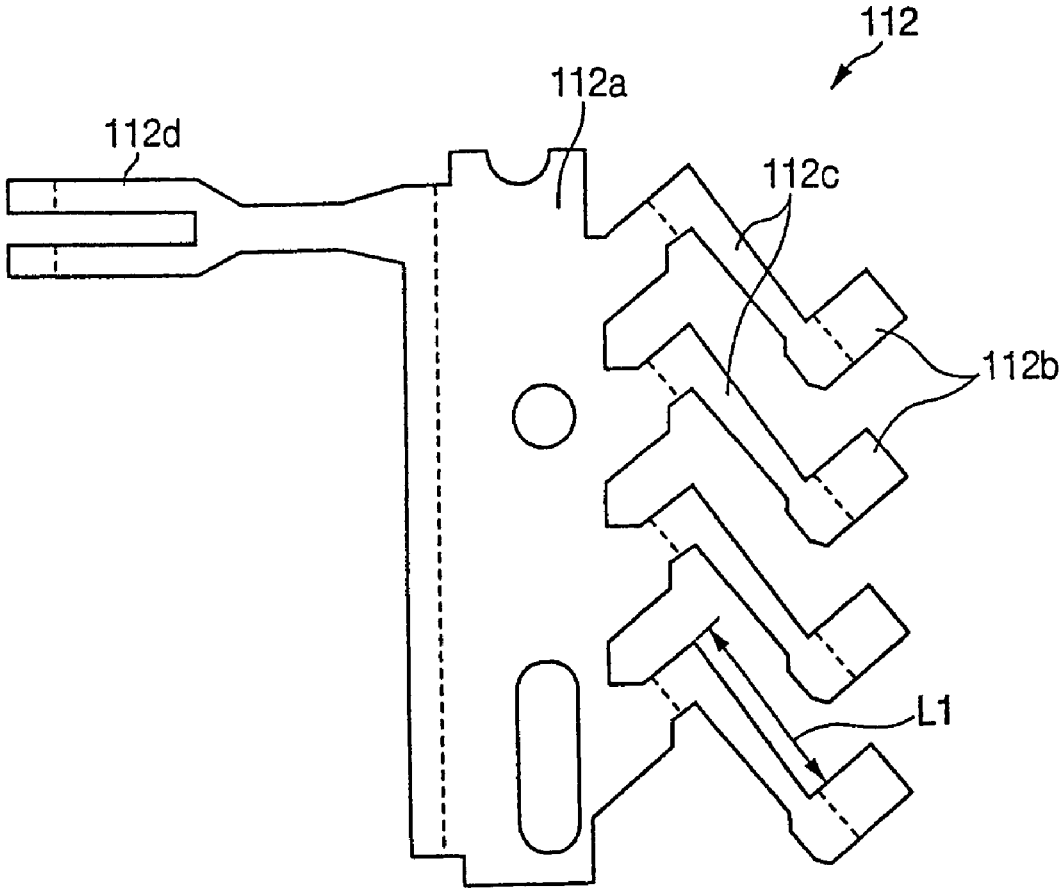
Fig. 2 (PRIOR ART)
FIG. 2 is a perspective view of one of the filament supports of FIG. 1 shown in a state where the filaments are unconnected to the filament support.

With reference also to FIG. 2, each of the filament supports 112 includes a fixing plate 112*a* welded to a mount 120 of a lead frame, which is connected to the first substrate 1116; tension heads 112*b*, each corresponding to one of the filaments 114 to fixedly secure the same; and tension arms 112*c* interconnecting the tension heads 112*b* and the fixing plate 112*a*. The tension arms 112*c* have a length L1 of approximately 2.5 mm (millimeters) in order to provide tension to the tension heads 112*b*. In FIG. 1, a length of the tension arms 112*c* in a state where the filaments 114 are attached to the tension heads 112*b* is shown as L2. In the following, it will be assumed that the length L2 of the tension arms 112*c* when the filaments 114 are connected to the tension heads 112*b* is the same as the length L1 of the tension arms 112*c* when the same are in a relaxed state.

Reference numeral 112*d* in FIG. 2 indicates a getter support, and the dotted lines indicate bending lines.

The VFD including the conventional filament supports 112 as described above has the following drawbacks.

If the frit glass (F) for sealing the side glass 118 and the lower substrate 116 contacts the tension arms 112*c*, the tension arms 112*c* lose their tension such that they are unable to support the filaments 114. Further, if the frit glass (F) is deposited on part of the fixing plates 112*a*, when the frit glass (F) is heated to seal the lower substrate 116 and the side glass 118, cracks may develop in the frit glass (F) as a result of the difference in thermal expansion coefficients between the frit glass (F) and the filament supports 112. As a result, foreign substances (frit particles) are created so that the inside of the VFD becomes contaminated. Also, this causes the fixing plates 112*a* to become loose or disconnected from the mounts 120 to thereby cause shaking of the filaments 114.

To overcome these problems, a gap (G) of 0.85 mm or more is maintained between the fixing plates 112*a* and the side glass 118 such that contact between the frit glass (F) and the filament supports 112 is prevented.

Therefore, in the VFD having the conventional filament supports 112, a significant amount of space is unable to be used by the anode electrodes 110 as viewing space. That is, the 0.85 mm for the gap (G) between short sides of the fixing plates 112*a* and the side glass 118, and the length L2 of 2.5 mm for the tension arms 112*c* when the filaments 114 are attached to the tension heads 112*b* combine for a total of approximately 3.3 mm that cannot be used by the anode electrodes 110 as viewing space. This increases the overall size of the VFD.

Preferred embodiments of the present invention will now be described in detail with reference to the accompanying drawings.

Figure 3:
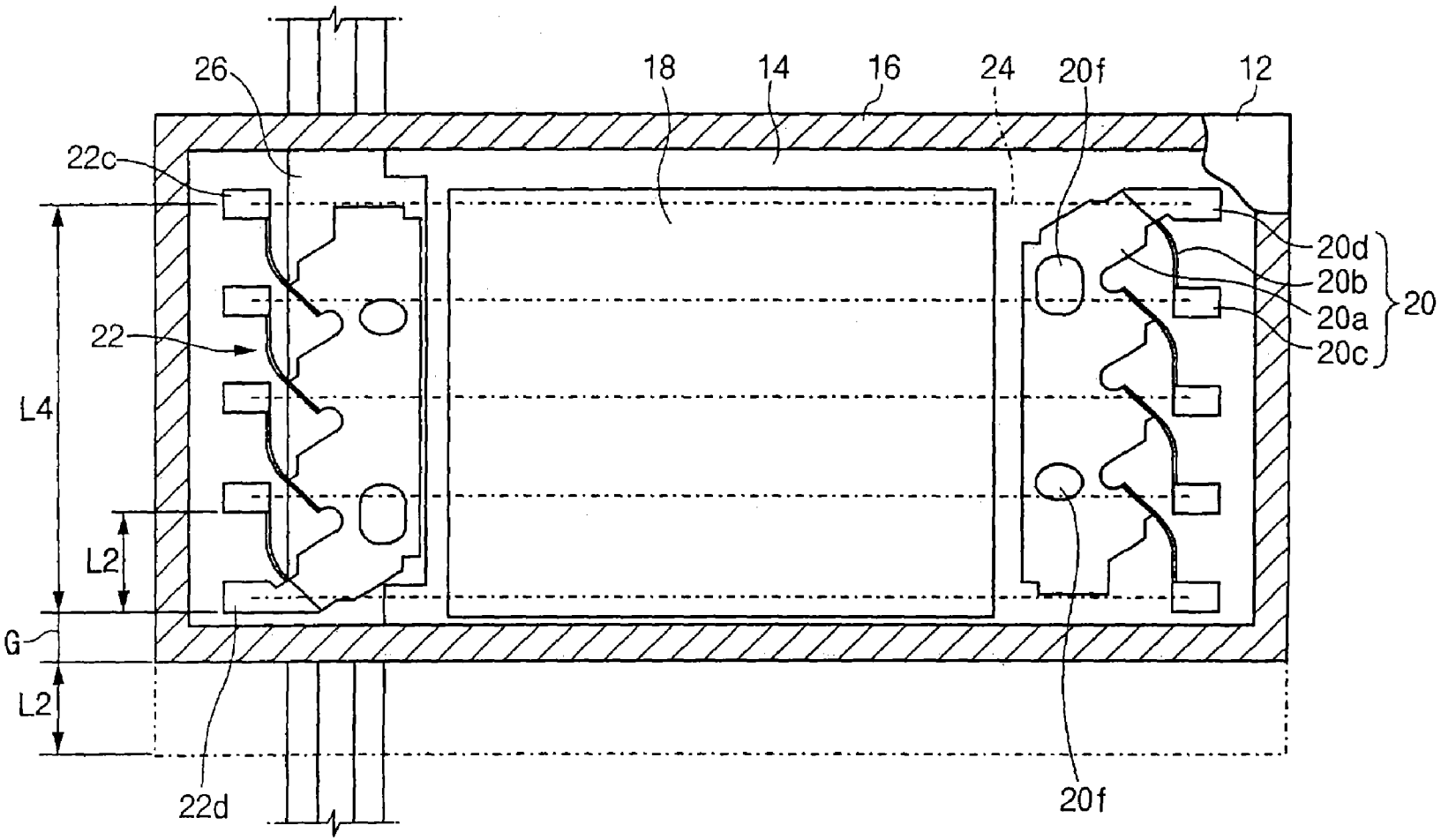
FIG. 3 is a plan view of a vacuum fluorescent display according to a first preferred embodiment of the present invention, in which the vacuum fluorescent display is shown in a state where filaments are mounted to complex-type filament supports.

FIG. 3 is a plan view of a vacuum fluorescent display according to a first preferred embodiment of the present invention.

The vacuum fluorescent display (VFD) includes first and second substrates 12 and 14; a side glass 16; an anode 18 that has a phosphor layer on which phosphors, to be illuminated, are printed in a predetermined pattern, and that has also a conducting layer for applying an external power to the phosphor layer; filaments 24 suspended a predetermined distance from the second substrate 14 by first and second complex-type supports 20 and 22; and a grid electrode (not shown) for accelerating and diffusing (or for blocking) electrons emitted from the filaments 24, the grid electrode being mounted at a predetermined distance from the filaments 24.

Figure 4:
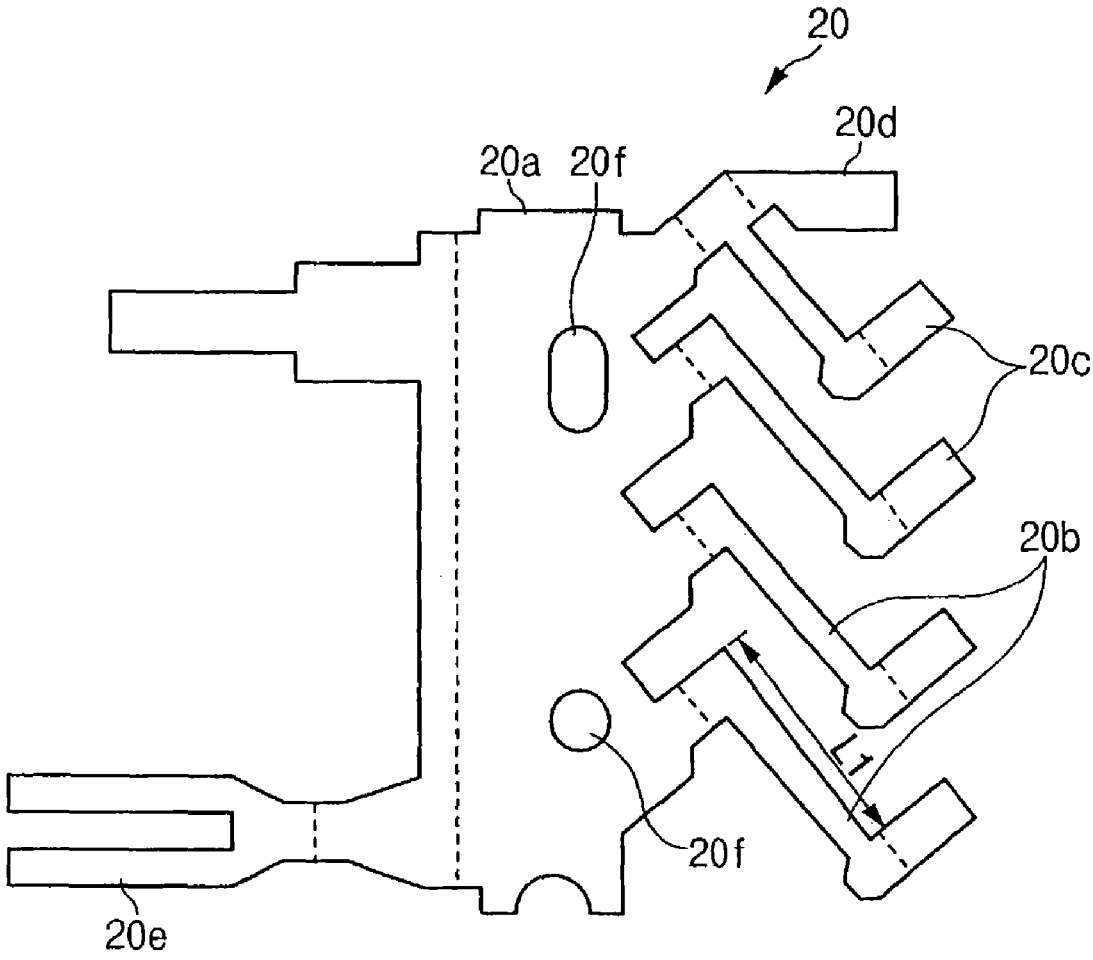
FIG. 4 is a perspective view of one of the complex-type supports of FIG. 3.

The first and second complex-type supports 20 and 22 fix opposite sides of each of the filaments 24 to maintain the filaments 24 in a predetermined level of tension. The first and second complex-type supports 20 and 22 will be described in more detail with reference also to FIG. 4. Since the first and second complex-type supports 20 and 22 are identical in structure and operation in the first preferred embodiment of the present invention, only the first complex-type support 20 will be described in the following.

The first complex-type filament support 20 includes a fixing plate 20*a*, tension arms 20*b*, tension heads 20*c*, and a tensionless head 20*d*. The fixing plate 20*a* is fixedly secured by welding to a mount 26 of a lead frame, which is provided on the second substrate 14. The tension arms 20*b* are formed by being bent in a vertical direction from the fixing plate 20*a* along bending lines (the dotted lines of FIG. 4). The tension heads 20*c* are formed by being bent in a horizontal direction along bending lines at distal ends of the tension arms 20*b*.

Further, the tensionless head 20*d* is mounted to one of the tension arms 20*b*, that is, one of the tension arms 20*b* that is furthermost along a length of the fixing plate 20*a*. The tensionless head 20*d* does not provide tension to the filament 24 attached thereto.

In the first preferred embodiment of the present invention, if a total number of tensionless heads 20*d* provided on the first complex-type filament support 20 is M, a total number of tensionless heads 22*d* provided on the second complex-type filament support 22 is M', and a total number of filaments 24 is N, the condition outlined by the following equality is satisfied.

$$M=M'=N-(N-1) \quad \text{[Equation 1]}$$

For example, in the case where there are provided five of the filaments 24, each of the first and second complex-type filament supports 20 and 22 includes four tension heads and tension arms, and one tensionless head.

In addition, the first and second complex-type filament supports 20 and 22 are provided such that the tensionless heads 20*d* and 22*d* are provided outwardly (extending in a direction away (from the anode 18) and diagonally from one another. For example, the first and second complex-type filament supports 20 and 22 are provided such that the tensionless heads 20*d* and 22*d* are positioned at right/upper and left/lower locations, respectively, in FIG. 3. Alternatively, the tensionless heads 20*d* and 22*d* may be provided at right/lower and left/upper locations, respectively.

Further, the fixing plate 20*a* of the first complex-type filament support 20 includes a getter support 20*e*, and pin insertion holes 20*f* into which jig pins (not shown) are inserted to align the mount 26 and the fixing plate 20*a*.

With the filament supports 20 and 22 structured as in the above, there is provided one of the tension heads 20*c* and 22*c* at areas opposing the tensionless heads 20*d* and 22*d*, respectively, to support the corresponding filaments 24. Accordingly, each of the filaments 24 is maintained with a predetermined level of tension applied thereto.

Also, in the complex-type filament supports 20 and 22 structured as in the above, a length L2 of the tension arms 20*b* may be reduced when compared to the same element of the conventional filament support (see reference numeral 112 of FIG. 1). For example, in order to secure five of the filaments 24, a length of L3 for the fixing plate 112*a* is needed in the conventional device as shown in FIG. 1. However, in the first preferred embodiment of the present invention, this length is reduced by as much as the length L2 of one of the tension arms 20*b* to result in a reduced overall length L4 for the fixing plate 20*a*. Accordingly, the VFD using the complex-type supports 20 and 22 of the present invention may be reduced in size by this length L2 of the tension arms 20*c*. The size of the conventional VFD is shown by dotted lines in FIG. 3.

Alternatively, instead of reducing the size of the VFD, a display area of the anode 18 may be enlarged by as much as the length L2 of the tension arms 20*c*. In this case, the fixing plates 20*a* and 22*a* of the filament supports 20 and 22 are increased in length to be identical to that in the conventional VFD and an additional tension head is provided.

Figure 5:
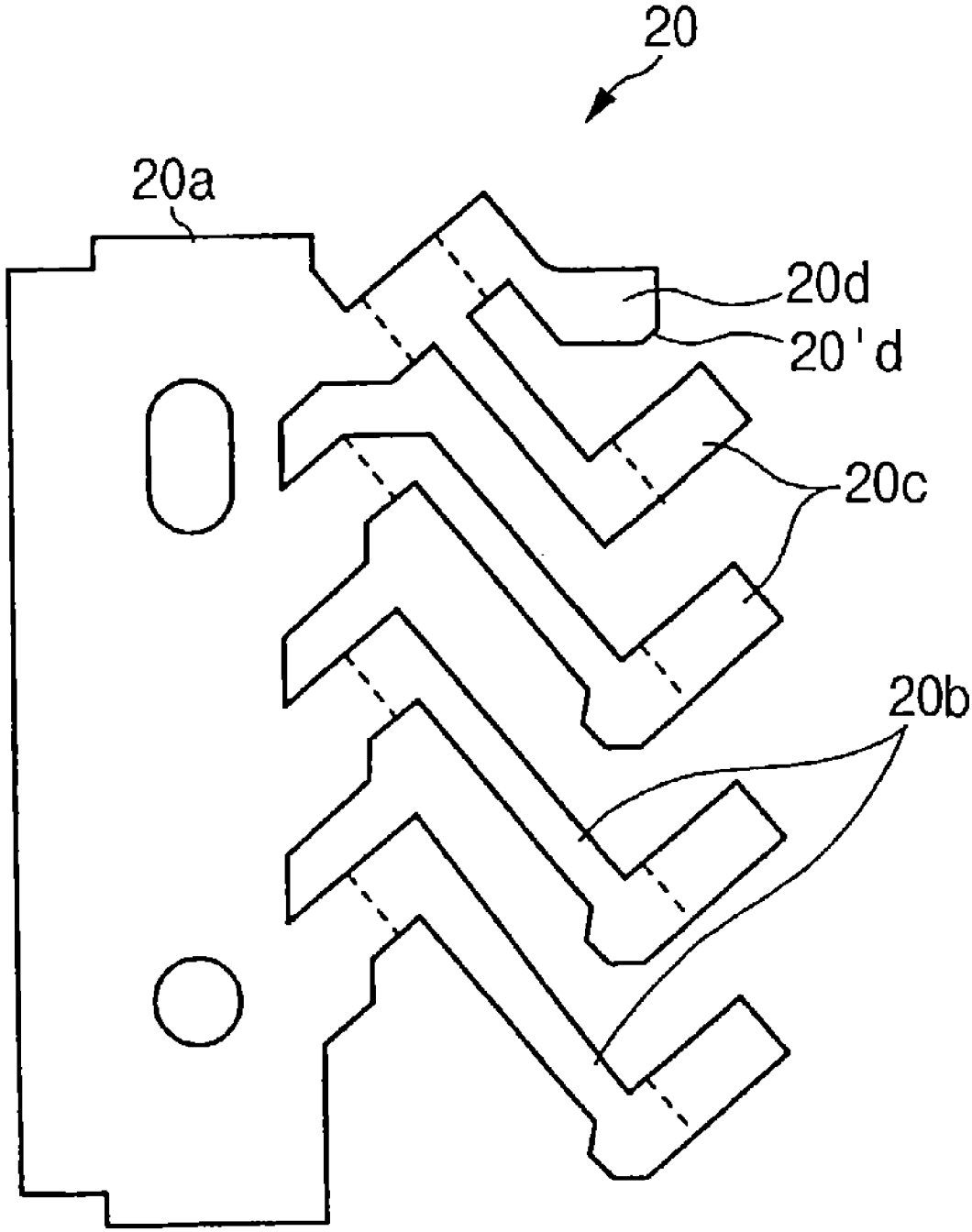
FIG. 5 is a perspective view of a modified example of one of the complex-type supports of FIG. 3.

FIG. 5 is a perspective view of a modified example of the first complex-type support 20 according to the first preferred embodiment of the present invention. As shown in the drawing, the tensionless head 20*d* is positioned closer toward the adjacent tension arm 20*b* and tension head 20*c*. Also, a cutaway section 20'*d* is formed in the end of the tensionless head 20*d* to increase a space between the adjacent tension head 20*c* and the tensionless head 20*d*.

Figure 6:
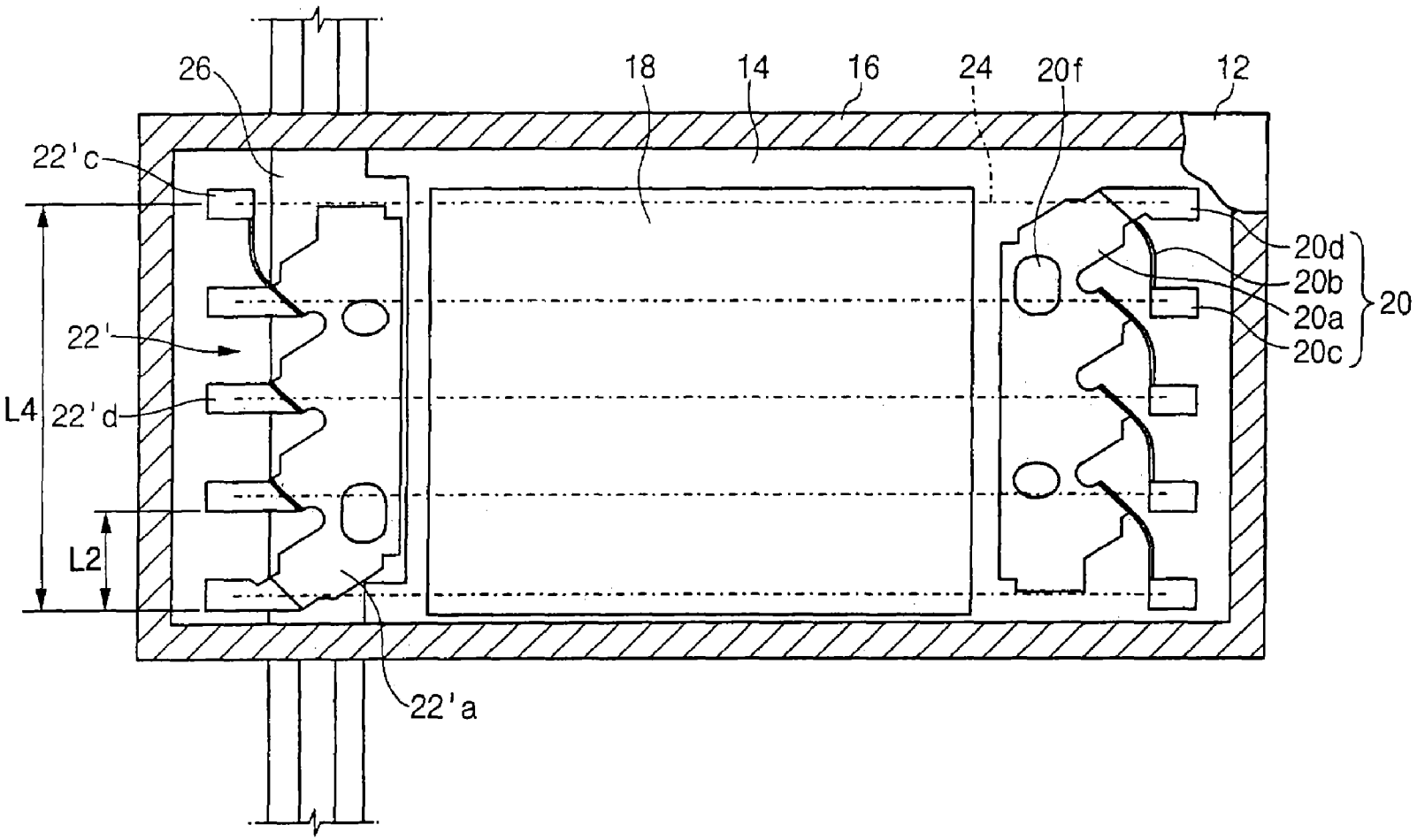
FIG. 6 is a plan view of a vacuum fluorescent display according to a second preferred embodiment of the present invention, in which the vacuum fluorescent display is shown in a state where filaments are mounted to complex-type filament supports.

FIG. 6 shows a plan view of a VFD according to a second preferred embodiment of the present invention. First and second complex-type filament supports 20 and 22' satisfy the condition as outlined by the following equation.

$$M=N-(N-1)$$

$$N-(N-2)\leqq M'\leqq N-1 \quad \text{[Equation 2]}$$

where M is a total number of tensionless heads 20*d* provided on the first complex-type filament support 20, M' is a total number of tensionless heads 22'*d* provided on the second complex-type filament support 22', and N is a total number of filaments 24.

Therefore, the first complex-type filament support 20 has one tensionless head 20*d* and is therefore identical to the first complex-type filament support 20 of the first preferred embodiment of the present invention described with reference to FIG. 3. However, the second complex-type filament support 22' has two or more tensionless heads 22'*d*. As an example, if there are five of the filaments 24 provided in the VFD, the second complex-type filament support 22' has two to four of the tensionless heads 22'*d*. FIG. 6 shows the case where the second complex-type filament support 22' has four tensionless heads 22'*d*.

Although not shown in the drawings, it is also possible to reverse the number of tensionless heads for the first and second complex-type filament supports 20 and 22'. That is, it is possible for the second complex-type filament support 22' to include one tensionless head and for the first complex-type filament support 20 to include two to four tensionless heads.

Referring to FIG. 6, reference 22'*c* refers to the tension head on the second complex-type filament support 22' and 22'*a* refers to the fixing plate of the second complex-type filament support 22'.

Figure 7:
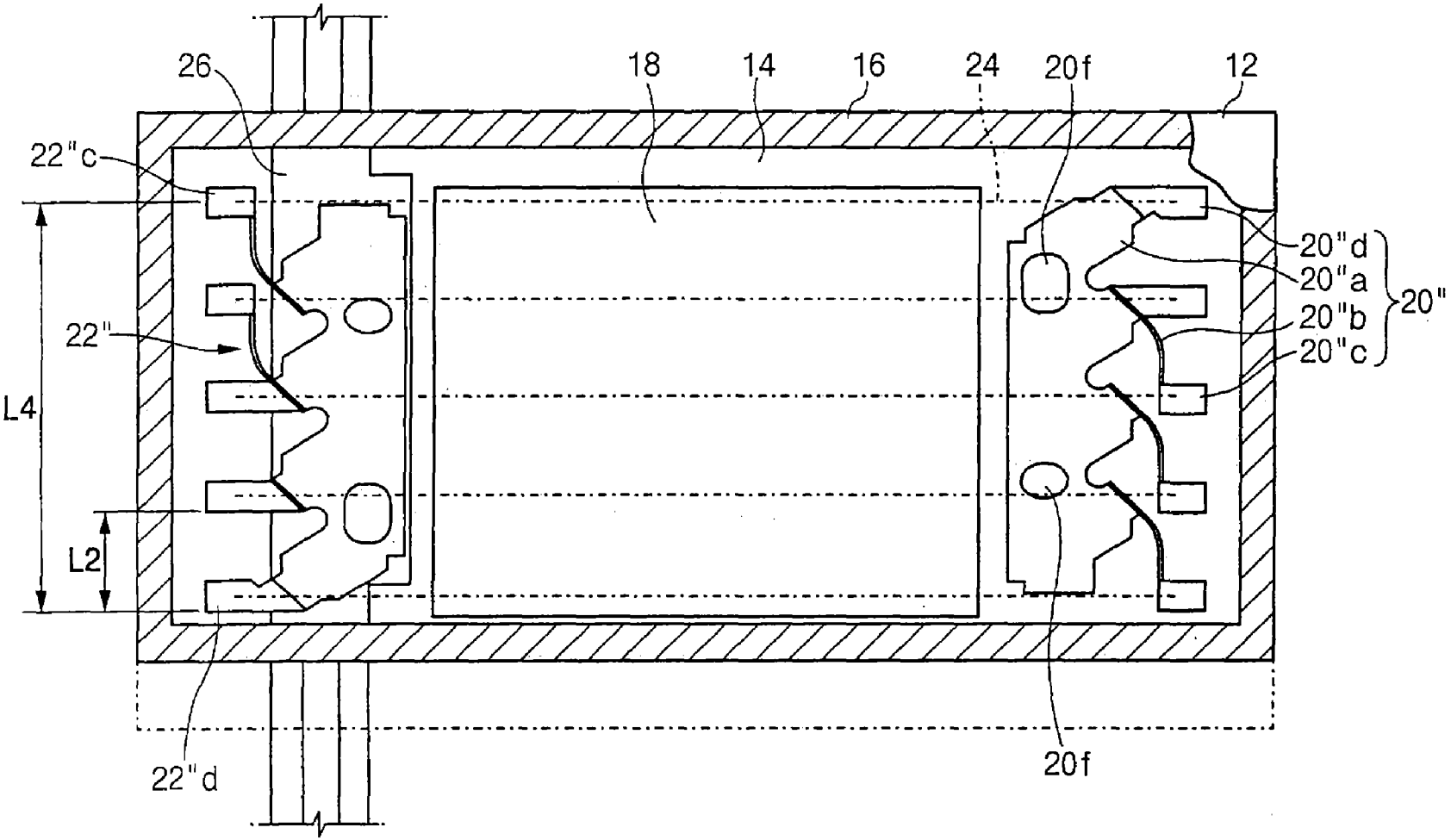
FIG. 7 is a plan view of a vacuum fluorescent display according to a third preferred embodiment of the present invention, in which the vacuum fluorescent display is shown in a state where filaments are mounted to complex-type filament supports.

FIG. 7 is a plan view of a VFD according to a third preferred embodiment of the present invention. First and second complex-type filament supports 20" and 22" satisfy the condition as outlined by the following equations.

$$N-(N-2)\leqq M\leqq N-1$$

$$N-(N-2)\leqq M'\leqq N-1 \quad \text{[Equation 3]}$$

where a total number of tensionless heads 20"*d* provided on the first complex-type filament support 20" is M, a total number of tensionless heads 22"*d* provided on the second complex-type filament support 22" is M', and a total number of filaments 24 is N.

Therefore, both the first and second complex-type filament supports 20" and 22" have two or more tensionless heads 20"*d* and 22"*d*. For example, in the case where there are five of the filaments 24 provided in the device, the first and second complex-type filament supports 20" and 22" have two to four of the tensionless heads 20"*d* and 22"*d*. In FIG. 7, the first complex-type filament support 20" includes two of the tensionless heads 20"*d*, while the second complex-type filament support 22" includes three of the tensionless heads 22"*d*.

FIG. 7 also shows the tension heads 22"*c* on the second complex-type filament support 22", and the first complex-type filament support 20" includes a fixing plate 20"*a*, tension arms 20"*b*, tension heads 20"*c*, and a tensionless head 20"*d*.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A vacuum fluorescent display, comprising:

first and second substrates provided opposing one another, and a side glass provided between the first and second substrates to seal a space therebetween;

filaments for emitting electrons when a voltage is applied thereto;

first and second filament supports mounted to one of the substrates and supporting opposite sides of each of the filaments; and an anode provided on at least one of the substrates, the anode being illuminated by electrons to realize images;

with at least one of the filament supports are formed of complex-type, the complex type filament supports include a fixed plate which is fixed to the one of the substrates, at least one tension arm mounted to the fixed plate, at least one tension head provided on a distal end of each of the tension arms, and at least one tensionless head to which one of the filaments is attached, the tensionless head being mounted to one of the tension arms.

2. The vacuum fluorescent display of claim 1, wherein the first and second filament supports are formed of complex-type, and either a tensionless head or a tension head is mounted to the second complex-type filament support opposing a tension head of the first complex-type filament support, and a tension head is mounted to the second complex-type filament support opposing a tensionless head of the first complex-type filament support.

3. The vacuum fluorescent display of claim 2, wherein the first and second complex-type filament supports satisfy:

$$M=M'=N-(N-1)$$

where M is a total number of the tensionless heads provided on the first complex-type filament support, M' is a total number of the tensionless heads provided on the second complex-type filament support, and N is a total number of the filaments.

4. The vacuum fluorescent display of claim 3, wherein the tensionless heads are provided toward short ends along a lengthwise direction of the fixed plates.

5. The vacuum fluorescent display of claim 4, wherein the tensionless heads are integrally formed to the tension arms at ends of the same opposite where the tension heads are formed.

6. The vacuum fluorescent display of claim 5, wherein a cutaway section is formed in each of the tensionless heads accommodating a gap between the tension heads and the tensionless heads being increased.

7. The vacuum fluorescent display of claim 2, wherein the first and second complex-type filament supports satisfy:

$$M=N-(N-1)$$

$$N-(N-2)\leqq M'\leqq N-1$$

where M is a total number of the tensionless heads provided on the first complex-type filament support, M' is a total number of the tensionless heads provided on the second complex-type filament support, and N is a total number of the filaments.

8. The vacuum fluorescent display of claim 7, wherein the tensionless heads are provided toward short ends along a lengthwise direction of the fixed plates.

9. The vacuum fluorescent display of claim 8, wherein the tensionless heads are integrally formed to the tension arms at ends of the same opposite where the tension heads are formed.

10. The vacuum fluorescent display of claim 8, wherein, among all of the tensionless heads, the tensionless heads provided toward short ends along the lengthwise direction of the fixed plates are integrally formed to the tension arms at ends of the same opposite where the tension heads are formed.

11. The vacuum fluorescent display of claim 10, wherein a cutaway section is formed in each of the tensionless heads that is adjacent to a tension head such that a gap between the tension heads and the tensionless heads is increased.

12. The vacuum fluorescent display of claim 2, wherein the first and second complex-type filament supports satisfy:

$$N-(N-2) \leqq M \leqq (N-1)$$

$$N-(N-2) \leqq M' \leqq N-1$$

where M is a total number of the tensionless heads provided on the first complex-type filament support, M' is a total number of the tensionless heads provided on the second complex-type filament support, and N is a total number of the filaments.

13. The vacuum fluorescent display of claim 12, wherein, among all of the tensionless heads, the tensionless heads provided toward short ends along the lengthwise direction of the fixed plates are integrally formed to the tension arms at ends of the same opposite where the tension heads are formed.

14. The vacuum fluorescent display of claim 13, wherein a cutaway section is formed in each of the tensionless heads that is adjacent to a tensionless tension head accommodating a gap between the tension heads and the tensionless heads being increased.

* * * * *